United States Patent [19]

Hasegawa et al.

[11] 4,265,994

[45] May 5, 1981

[54] PRESSURE FIXABLE CAPSULE TONER

[75] Inventors: Tetsuo Hasegawa, Tokyo; Shigeo Kato, Noda; Takeshi Miyashita, Yokohama, all of Japan

[73] Assignee: Canon Kabushiki Kaisha, Tokyo, Japan

[21] Appl. No.: 58,671

[22] Filed: Jul. 18, 1979

[30] Foreign Application Priority Data

Jul. 18, 1978 [JP] Japan ..... 53/87328
Jul. 28, 1978 [JP] Japan ..... 53/92102
Jul. 28, 1978 [JP] Japan ..... 53/92103

[51] Int. Cl.[3] ..... G03G 9/00

[52] U.S. Cl. ..... 430/107; 430/109; 430/110; 430/111

[58] Field of Search ..... 430/109, 110, 98, 111, 430/107, 904; 428/407, 403

[56] References Cited

U.S. PATENT DOCUMENTS

| | | | |
|---|---|---|---|
| 3,095,755 | 5/1963 | Erchak et al. | 430/109 |
| 3,510,338 | 5/1970 | Varron | 430/109 |
| 3,788,994 | 1/1974 | Wellman et al. . | |
| 3,965,022 | 6/1976 | Strong et al. | 430/110 |
| 3,974,078 | 8/1976 | Crystal . | |
| 4,082,681 | 4/1978 | Takayama et al. | 430/109 |
| 4,175,962 | 11/1979 | Sadamatsu et al. | 430/109 |

FOREIGN PATENT DOCUMENTS

| | | |
|---|---|---|
| 1210665 | 10/1970 | United Kingdom . |
| 1279291 | 6/1972 | United Kingdom . |
| 1406687 | 9/1975 | United Kingdom . |
| 1431699 | 4/1976 | United Kingdom . |
| 1462108 | 1/1977 | United Kingdom . |

*Primary Examiner*—Mary F. Downey
*Attorney, Agent, or Firm*—Fitzpatrick, Cella, Harper & Scinto

[57] ABSTRACT

A pressure fixable capsule toner comprises a core material containing a pressure fixable component and an outer shell layer covering the core material and containing a cyclized rubber.

12 Claims, No Drawings

PRESSURE FIXABLE CAPSULE TONER

BACKGROUND OF THE INVENTION

1. Field of the Invention

This invention relates to a toner for developing electric latent images or magnetic latent images in electrophotographic processes, electrostatic printing processes and the like, and more particularly, to a capsule toner suitable for pressure fixation.

2. Description of the Prior Art

Heretofore there have been known various electrophotographic processes such as those disclosed in U.S. Pat. No. 2,297,691, British Pat. No. 1,165,406, and British Pat. No. 1,165,405. These processes usually comprise utilizing a photoconductive material, forming electric latent images on a photosensitive member by some means, developing the latent images with a toner, if desired, transferring the developed toner images to a receiving sheet such as paper and then fixing the toner images by heat, pressure, or solvent vapor.

There are known various methods for visualizing electric latent images with a toner. For example, there may be mentioned magnetic brush development as described in U.S. Pat. No. 2,874,063, cascade development as described in U.S. Pat. No. 2,618,552, powder cloud development as described in U.S. Pat. No. 2,221,776, fur-brush development, liquid development and the like. Toners used for these development methods are heretofore fine powders composed of dyes or pigments dispersed in natural or synthetic resins. If desired, third components are added to the fine powders.

Developed toner images may be transferred to a receiving sheet and fixed, if desired.

As a method of fixing toner images, there may be mentioned a method comprising heating and melting toner particles by a heater or heat roller and fusing followed by solidifying on the support, a method for fixing toner particles to a supporting member by softening or melting the resin binder in toner particles with an organic solvent, a method for fixing toner particles to a supporting member by pressure, and the like.

Materials for toner particles are selected in such a way that they are suitable for each particular fixing method. Therefore, a toner suitable for a particular fixing method is usually not usable for the other fixing methods.

In particular, a toner used for widely used, conventional heat fusing fixing methods employing a heater is hardly possible to be applied to a heat roller fixing method, a solvent fixing method, a pressure fixing method and the like. Therefore, toners suitable for each particular fixing method are researched and developed.

The method for fixing toners by pressure is for example, disclosed in U.S. Pat. No.; b 3,269,626 and Japanese Patent Publication No. 15876/1971. The method has various advantages, that is, less consumption of energy, non-pollution, copying without a waiting time by simply switching on a copying machine, no fear of burning and scorching copies, high speed fixing and a simple fixing device and the like.

However, the pressure fixing method has some disadvantage such as poor fixability of a toner, offsetting to the pressure roller and the like. Therefore, researchers have been made to improve the pressure fixation. For example, British Pat. No. 1,210,665 discloses a pressure fixation toner containing an aliphatic component and a thermoplastic resin; U.S. Pat. No. 3,788,994, U.S. Pat. No. 3,974,078, Japanese Patent Laid Open Nos. 17739/1974 and 108134/1977 disclose pressure fixable toners of a capsule type containing a soft material in the core; and Japanese Patent Laid Open No. 75033/1978 discloses a pressure fixable toner composed of a block copolymer derived from a sticky and strong polymer and a soft polymer.

However, any practical pressure fixable toner is not yet obtained which can be easily produced, has a sufficient pressure fixability, does not cause offsetting to the pressure roller, is stable in points of developing property and fixability upon repeating use, does not adhere to carrier, metal sleeve and surface of the photosensitive member and has a good storage stability, i.e. non-agglomerative and non-caking.

For example, a pressure fixable toner comprising a soft material is of good pressure fixability, but is disadvantageous because this type of toner can not be easily pulverized to toner particles, easily causes offsetting to a pressure roller and adhering to a carrier and a surface of photosensitive member and causes agglomeration and caking during storage.

Rigid resins can be used to make easily toners and the resulting toners are of good chargeability and storage, but have a very poor pressure fixability because most rigid resins are harder than cellulose fibers constituting papers and when they are pressed, they are not entangled with the fibers, but simply crashed in the paper.

When a soft material of good pressure fixability is used as a core material in conventional pressure fixable capsule toners, the soft material gradually adheres to the pressure roller during repeating pressure fixation and, therefore, this disadvantageously causes offsetting and the receiving paper is adhesively wound round the roller.

If one tries to avoid such phenominon, the pressure fixability is lowered. In short, a toner of high pressure fixability gives poor image quality while a toner capable of giving good image quality is poor at fixation.

Conventional capsule toners are easily broken even by a slight impact and the outer shell and the core are separated from each other, and the like is short and the resulting image quality is poor.

There has been recently used a method of developing electrostatic images with a one-component developer which has toner particles containing magnetic fine powder and does not use any carrier particles. In this method the toner binder resin is required to have good dispersibility and contacting property with respect to the magnetic fine powders and the toner particles are required to have high impact strength and fluidity. In addition, when the core material and the shell material are separated from each other during development carried out by triboelectric charge caused by the one-component developer and the developing sleeve roller, the shell material is adhered to the sleeve roller by triboelectric force and accumulated, and therefore the durability is very poor. In view of the foregoing, practical capsule toners have not yet been provided.

SUMMARY OF THE INVENTION

An object of the present invention is to provide a capsule toner of high pressure fixability.

Another object of the present invention is to provide a capsule toner of high chargeability, impact strength and long life.

Further object of the present invention is to provide a capsule toner easily produced and having high storage stability.

Still another object of the present invention is to provide a capsule toner which has excellent developing ability, pressure fixability and can be electrostatically transferred even when it is used in the form of magnetic toner for a one-component development by incorporating magnetic fine powders in the toner.

According to the present invention, there is provided a pressure fixable capsule toner which comprises a core material containing a pressure fixable component and an outer shell layer covering the core material and containing a cyclized rubber.

DESCRIPTION OF THE PREFERRED EMBODIMENT

As a material for the pressure fixable component to be incorporated in the core material, such material is preferably which can easily entangle with fibers of ordinary paper when a line pressure of about 20 kg/cm is applied.

The material includes polyolefines such as polyethylene, polypropylene, polytetrafluoroethylene, polyethylene oxide, and the like, ethylene-acryl copolymer, polyethylene vinyl acetate, polyester, styrene series resins such as polystyrene, styrene-butadiene copolymer, polystyreneacryl and the like, higher fatty acids such as palmitic acid, stearic acid, lauric acid and the like, polyvinyl-pyrrolidone, epoxy resins, phenol-terpene copolymer, silicone resin, maleic acid modified phenolic resin, methyl vinyl ether-maleic anhydride copolymer and the like.

Among the polyethylenes as mentioned above, polyethylene oxide disclosed in U.S. Pat. No. 3,339,850 is preferable. In particular, the polyethylene oxide having density of more than 0.95 g/cm$^3$, melt index (MI) of more than 100, preferably, more than 300 and of a low molecular weight shows a good pressure fixability to ordinary paper. The density is measured according to ASTMD 1505-57T and melt index (MI) is calculated by the formula $\log MI = 0.921 \log F + 1.039$ where the flow rate, F, is measured under condition $-D$ according to ASTMD 1238-57T.

The core material is covered by an outer shell layer comprising cyclized rubber. The amount of the cyclized rubber may be more than 40% by weight of the outer shell layer, preferably, more than 50% by weight of the outer shell layer. Cyclized rubber is generally explained, for example, in R. E. Kirk and D. F. Othmer, Encyclopedia of Chemical Technology, Vol. 11, pp. 706-708 (1953) and Kagaku Daijiten (Encyclopaedia Chimica), Vol. 2, pp. 615-616 (published by Kyoritsu Shuppan, Japan, 1960). Cyclized rubbers having iodine value of 40-200 and molecular weight of 5,000-20,000 are preferable. Thickness of the cyclized rubber containing layer, i.e. the outer shell layer, is usually 0.1-8 μm, preferred with 0.8-4 μm.

Other insulating materials constituting the cyclized rubber containing layer are preferably such materials that have a good film shapeability when mixed with cyclized rubber to form a film around the core material, have good chargeability, are of non-agglomeration, and do not adversely affect the pressure fixability.

Such other insulating materials include homopolymers or copolymers of styrene or substituted styrene such as polystyrene, poly-p-chlorostyrene, polyvinyltoluene, styrene-butadiene copolymer, styrene-acrylic acid copolymer, styrene-maleic anhydride copolymer and the like, polyester resins, acrylic resins, xylene resins, polyamide resins, ionomer resins, furan resins, ketone resins, terpene resins, phenol modified terpene resins, rosin, rosin modified pentaerythritol ester, natural resin modified phenolic resins, natural resin modified maleic acid resins, coumaroneindene resins, maleic acid modified phenolic acid resins, cycloaliphatic hydrocarbon resins, petroleum resins, phthalic acid cellulose acetate, anethyl vinyl ether-maleic anhydride copolymer starch graft polymer, polyvinylbutyral, polyvinylalcohol, polyvinylpyrrolidone, chlorinated paraffine, waxes, fatty acids and the like, the above mentioned materials may be used alone or in combination.

Among them, styrene resins, polyester resins, maleic acid modified phenolic resins, phthalic acid cellulose acetate, starch graft copolymer and polyvinylbutyral are particularly preferable.

The cyclized rubber containing layer may contain almost 100% by weight of cyclized rubber. A costing layer comprising the above-mentioned insulating material may cover the cyclized rubber containing layer (almost 100% by weight of cyclized rubber).

The outer shell layer may contain a certain amount of a charge controlling agent used conventionally for toners such as metal containing dyes, nigrosine and the like and a lubricant such as hydrophobic colloidal silica.

Naturally, the charge controlling agent and the lubricant may be mixed with the capsule toner particles without incorporating them in the capsule toner particles.

Conventional coloring agents, such as dyes and pigments for toners may be used for the capsule toners according to the present invention, if desired. The coloring agent may be added to one or both of the core material and the outer shell layer.

Where magnetic toners are wanted, magnetic fine powders are incorporated in toners. As the magnetic materials, there may be used materials showing magnetism and magnetizable materials conventionally known as magnetic materials such as fine powders of iron, manganese, nickel, cobalt, chromium and the like, various ferrites, alloys and compound of manganese and the like, and ferromagnetic alloys.

These magnetic fine powders may be incorporated in either the core material or the outer shell layer, but where insulating toners are desired, it is preferable to add magnetic fine powders to the core material.

The capsule toners according to the present invention may be produced by known techniques for forming capsules. Such techniques include spray dry method, interfacial polymerization, coacervation, phase separation, in-situ polymerization, methods disclosed in U.S. Pat. Nos. 3,338,991, 3,326,848 and 3,502,582.

Toner images formed by the capsule toner according to the present invention are passed between a pair of pressure rollers to fix, and if desired, auxiliary heating may be made.

As pressure fixing devices which can be used for the capsule toners of the present invention, there are disclosed, for example, Japanese Patent Publication No. 12797/1969, U.S. Pat. Nos. 3,269,626, 3,612,682, 3,655,282 and 3,731,358.

Fixability may be evaluated according to a color fastness testing method (JIS-L0849-1971) with respect to friction. A friction tester is used according to the prescribed method (dry test), and the surface where the toner is fixed and a white cotton cloth for friction are rubbed each other. The degree of the resulting coloring of the white cotton cloth for friction is compared with a gray sclae for dirtying. The degree of fixability is classified to from grade-1 to grade-10. At grade-1 and grade-2 any prectical fixation is not attained while at grade-3 or higher, preferably grade-4 or higher, practical fixation can be attained.

Capsule toners for pressure fixation according to the present invention can withstand impact of higher than 10 kg/cm$^2$ resulting in a long life, have excellent fluidity, do not adhere to carrier, developing sleeve and a surface of photosensitive member, and further have excellent pressure fixability and do not cause offsetting to a pressure roller.

When the capsule toners according to the present invention are used, there can be produced clear and sharp images of good chargeability and free from fog, and even after copying many times, the developing property and fixability are stable and therefore, life of the toner is long.

In addition, the capsule toners according to the present invention have a good storage stability, that is, they neither agglomerate nor cake during storage.

Even when the capsule toner is used as a magnetic toner for a one-component developer by incorporating magnetic particles therein, the developing property and pressure fixability are excellent and electrostatic transferring of images can be effected.

The following examples are given for the purpose of illustration and not by way of limitation. In the examples, parts are by weight unless otherwise specified.

EXAMPLE 1

In Examples 1–12 the cyclized rubber containing layer is composed of 100% by weight of cyclized rubber.

| | |
|---|---|
| Polyethylene oxide (average molecular weight 4000, acid value 20, Specific gravity 0.99, melt index 1000) | 200 parts |
| Magnetite (tradename, EPT-1000, supplied by Toda Kogyo) | 100 parts |

A mixture of the above components was melted and kneaded at 140° C. for 40 min. by a roll-mill and pulverized to powders of 5–20 μm in size by using a jet pulverizer (tradename, 100 NP, suppled by Nihon Pneumatic Kogyo). The resulting powders were used as a core material and were dispersed in a solution composed of the following components.

| | |
|---|---|
| Cyclized rubber (Iodine value 165, average molecular weight 10,000, tradename, "Alpex CK 450", supplied by Hoechst) | 50 parts |
| Xylene | 500 parts |

From the resulting dispersion liquid were produced capsule toner particles of 6–26 μm in size by using a spray dryer (inlet temperature 150° C., outlet temperature 100° C., wind rate 9 m$^3$/min., two-fluid nozzle type, supplied by Mitsubishi Kakoki). The resulting capsule toner particles were mixed with iron powder carrier and the triboelectric charge amount was measured. It was −11 μc/g.

The magnetic capsule toner particles alone were placed in a developing device of a dry type electrophotographic copier (tradename, NP-5000, supplied by Canon K. K.) and the fixing device was replaced by a fixing roller supplied by Develop Co. (two rigid, chronium plated rollers, i.e. upper and lower rollers, total pressure of 460 Kg) to produce clear and sharp images free from fog and of excellent fixability. For a duration test, ten thousand sheets of duplication were produced continuously, and the last duplication is still comparable to the duplication at beginning with respect to image quality and fixability. The fixability was grade-4 or grade-5.

Triboelectric charge of the toner after duplicating 10,000 sheets was −10.3 μc/g.

EXAMPLE 2

Repeating the procedure of Example 1 except that 10 parts of carbon black was used in place of the magnetite, there was obtained a capsule toner.

10 parts of the resulting capsule toner was mixed with 90 parts of iron powder carrier (tradename, EFV 200/300, supplied by Nihon Teppun) to produce a developer and the resulting developer was used for duplication as in Example 1. The resulting images at the beginning and the end of the duration test were of good fixability and were sharp. The fixability was grade-5.

EXAMPLES 3–12

One-component developers containing magnetic powders and having the ingredients as shown in the table below were produced by following the procedure of Example 1 and were subjected to the duration test. There were obtained sharp and durable fixed images.

| Example No. | Core material | Outer shell layer | Fixability | Duration test | Triboelectric charge at the beginning (μc/g) | Triboelectric charge after duration test (μc/g) |
|---|---|---|---|---|---|---|
| 3 | The same as Example 1. | Cyclized rubber, Iodine value 65, Average molecular weight 10,000, Tradename, "Alpex CK-514", supplied by Hoechst. | Grade-4 \| Grade-5 | Over 10,000 sheets | −10 | −8.2 |
| 4 | The same as Example 1. | Cyclized rubber, Tradename, "Thermolite N", supplied by Seiko Kagaku. | Grade-4 \| Grade-5 | Over 10,000 sheets | −12 | −7.2 |

-continued

| Example No. | Core material | Outer shell layer | Fixability | Duration test | Tribo-electric charge at the beginning (μc/g) | Tribo-electric charge after duration test (μc/g) |
|---|---|---|---|---|---|---|
| 5 | Polyethylene oxide, Average molecular weight 4,000, Specific gravity 0.97, Melt index 200. | Cyclized rubber, Tradename, "Thermolite P", supplied by Seiko Kagaku. | Grade-4 \| Grade-5 | Over 10,000 sheets | −11.5 | −9.3 |
| 6 | Polyethylene oxide, Average molecular weight 4,000, Specific gravity 0.97, Melt index 200. | Cyclized rubber, Tradename, "thermolite S", supplied by Seiko Kagaku | Grade-4 \| Grade-5 | Over 10,000 sheets | −10.2 | −8.5 |
| 7 | Polytetrafluoroethylene Powder Tradename, "Luvlon L-5", supplied by Daikin Kogyo. | The same as Example 1. | Grade-4 \| Grade-5 | Over 10,000 sheets | −12.3 | −11.3 |
| 8 | Polytetrafluoroethylene Powder Tradename, "Luvlon L-5" supplied by Daikin Kogyo. | The same as Example 3. | Grade-4 \| Grade-5 | Over 10,000 sheets | −13.2 | −10.2 |
| 9 | Polyethylene, Tradename, "AC-6". | The same as Example 1. | Grade-3 \| Grade-4 | Over 10,000 sheets | −12.4 | −10.4 |
| 10 | Ethylene-acryl copolymer, Tradename, "Pararoid B-72", supplied by Sanyo Boeki. | The same as Example 1. | Grade-3 \| Grade-4 | Over 10,000 sheets | −12.3 | −11.3 |
| 11 | Ethylene-acryl copolymer, Tradename, "Pararoid B-72", supplied by Sanyo Boeki. | The same as Example 3. | Grade-3 \| Grade-4 | Over 10,000 sheets | −11.4 | −10.8 |
| 12 | Stearic acid | The same as Example 3. | Grade-4 \| Grade-5 | Over 10,000 sheets | −10.5 | −8.2 |

EXAMPLE 13

In Examples 13–23 a cyclized rubber layer is provided on a core material and further an insulating resin layer is provided on the cyclized rubber layer.

| | |
|---|---|
| Polyethylene oxide (average molecular weight 1500, acid value 20, specific gravity 0.99, melt index 1000) | 100 parts |
| Magnetite (tradename, EPT-1000, supplied by Toda Kogyo) | 50 parts |

A mixture of the above components was melted and kneaded at about 150° C. for 30 min. by a roll-mill and then pulverized to powders of about 3–10 microns in size by a jet pulverizer. The resulting powders were sufficiently dispersed in a 5% solution of a cyclized rubber ("Alpex CK450", supplied by Hoechst) in xylene and the resulting liquid dispersion was treated by a spray dryer at a hot air inlet temperature of 170° C. and an exhausting air outlet of 120° C. to form powders of about 5–15 microns in size.

The resulting powders were sufficiently dispersed in a 10% solution of a styrene-butadiene copolymer (15:85, ratio by weight) in methyl ethyl ketone and then the dispersion was again treated by a spray dryer at a hot air inlet temperature of 150° C. and at an exhausting air outlet of 110° C. to form capsule toner particles of about 5–15 microns in size.

The triboelectric charge between the resulting capsule toner and a stainless steel screen of 4000 mesh was −2.5 μc/g.

Then, the resulting magnetic capsule toner particles alone were placed in a developing device in a dry type electrophotographic copier (tradename, NP-5000, supplied by Canon K. K.) and the fixing device was replaced by a fixing roller supplied by Develop Co. (two rigid, chromium plated rollers, i.e. upper and lower rollers, total pressure of 460 kg) to produce clear and sharp images free from fog and of excellent fixability.

For a duration test, 35,000 sheets of duplication were produced continuously, and the last duplication is still comparable to the duplication at the beginning with respect to image quality and fixability. The fixability was grade-5 or grade-6.

Triboelectric charge of the toner after duplicating 35,000 sheets was −2.5 μc/g.

EXAMPLE 14

Repeating the procedure of Example 13 except that 10 parts of carbon black was used in place of magnetite, there were obtained capsule toner particles.

The resulting capsule toner particles (10 parts) were mixed with 90 parts of iron powder carrier (tradename, EFV200/300, supplied by Nihon Teppun) to make a developer. The developer was used to develop images in a way similar to Example 13. Sharp images of good fixability were produced at the end of duplication as well as at the beginning. The result of the fixability test was grade-5.

EXAMPLES 15–23

Repeating the procedure of Example 13 except that the toner composed of the materials listed in the following table, there was produced one-component developer and the test was carried out. In each case, sharp and durable fixed images were obtained.

IN comparison Example 1, "Epikote 1002" is an epoxy resin. In comparison Example 2, no cyclized rubber layer was used. In Comparison Example 3, a too thick cyclized rubber layer was used.

| Example No. | Core Material | Cyclized rubber layer | Thickness of Cyclized rubber layer (μ) | Insulating Resin layer | Fixability | Image quality | Duration test (sheets) |
|---|---|---|---|---|---|---|---|
| 15 | Polyester resin | "Alpex CK 450", supplied by Hoechst, iodine value 165, molecular weight of 10,000 | 0.5 | Polystyrene resin | Grade-4 \| Grade-5 | Good | 40,000 |
| 16 | Ethylene-acryl copolymer | "Alpex CK 450", supplied by Hoechst, iodine value 165, molecular weight of 10,000 | 0.8 | Styrene-maleic anhydride copolymer | Grade-5 \| Grade-6 | Good | 45,000 |
| 17 | Phenol-terpene copolymer | "Alpex CK514", supplied by Hoechst, iodine value 55–60, molecular weight 10,000 | 1.5 | Acrylic resin | Grade-5 \| Grade-5 | Good | 33,000 |
| 18 | Ethylene methacrylate | "Alpex CK 514", supplied by Hoechst, iodine value 55–60, molecular weight 10,000 | 5 | Polyvinyl-pyrrolidone | Grade-4 \| Grade-5 | Good | 30,000 |
| 19 | The same as Example 13 | "Thermolite H", supplied by Seiko Kagaku | 3 | Ionomer resin | Grade-5 \| Grade-6 | Good | 30,000 |
| 20 | Ethylene methacrylate | "Thermolite H", supplied by Seiko Kagaku | 3.5 | Phthalic acid cellulose acetate | Grade-4 \| Grade-5 | Good | 38,000 |
| 21 | The same as Example 13 | "Thermolite N", supplied by Seiko Kagaku | 4 | Starch graft polymer | Grade-5 \| Grade-6 | Good | 30,000 |
| 22 | Maleic acid modified phenolic resin | "Thermolite N", supplied by Seiko Kagaku | 4.5 | Polyvinyl butyral | Grade-5 | Good | 53,000 |
| 23 | Polyethylene tetrafluoride | The same as Example 15 | 3 | The same as Example 13 | Grade-4 \| Grade-5 | Good | 50,000 |
| Comparison Example 1 | Polystyrene-acryl | "Epikote 1002", supplied by Shell Chemical Co. | 2 | Polyvinyl-alcohol | Grade-3 \| Grade-4 | Good | 10,000 |
| Comparison Example 2 | The same as Example 13 | none | — | The same as Example 13 | Grade-4 \| Grade-5 | Good | 10,000 |
| Comparison Example 3 | The same as Example 13 | The same as Example 13 | 10 | The same as Example 13 | Grade-4 \| Grade-5 | Good | 12,000 |

EXAMPLE 24

In Examples 24–33, an insulating material component was incorporated in the cyclized rubber containing layer.

| | |
|---|---|
| Polyethylene oxide (average molecular weight 1500, acid value 20, Specific gravity 0.99, melt index 1000) | 200 parts |
| Magnetite (tradename, EPT-1000, supplied by Toda Kogyo) | 100 parts |

A mixture of the above components was melted and kneaded at 140° C. for 40 min. by a roll-mill and pulverized to powders of 5–20 μm in size by using a jet pulverizer (tradename, 100 NP, supplied by Nihon Pneumatic Kogyo). The resulting powders were used as a core material and were dispersed in a solution composed of the following components.

| | |
|---|---|
| Cyclized rubber (Iodine value 165, average molecular weight 10,000, tradename, "Alpex CK450", supplied by Hoechst) | 75 parts |
| Styrene-butadiene copolymer (styrene/butadiene = 85 we. %/15 wt. %, #544, supplied by Denki Kagaku Koyo) | 25 parts |

-continued

| | |
|---|---|
| Xylene | 500 parts |

From the resulting dispersion liquid were produced capsule toner particles of 10–30 μm in size by using a spray dryer (inlet temperature 150° C., outlet temperature 100° C., wind rate 9 $m^3$/min., two-fluid nozzle type, supplied by Mitsubishi Kakoki). The resulting capsule toner particles were mixed with iron powder carrier and the triboelectric charge was measured. It was −15 μc/g.

The magnetic capsule toner particles alone were placed in a developing device of a dry type electrophotographic copier (tradename, NP-5000, supplied by Canon K. K.) and the fixing device was replaced by a fixing roller supplied by Develop Co. (two rigid, chromium plated rollers, i.e. upper and lower rollers, total pressure of 460 Kg) to produce clear and sharp images free from fog and of excellent fixability. For a duration test, ten thousand sheets of duplication were produced continuously, and the last duplication is still comparable to the duplication at the beginning with respect to image quality and fixability. The fixability was grade-4 or grade-5.

Triboelectric charge of the toner after duplicating 10,000 sheets was −13.2 μc/g.

EXAMPLE 25

Repeating the procedure of Example 24 except that 10 parts of carbon black was used in place of magnetite, there was obtained a capsule toner.

10 parts of the resulting capsule toner was mixed with 90 parts of iron powder carrier (EFV 200/300, tradename, supplied by Nihon Teppun) to produce a developer, which was used for developing as in Example 24. Sharp and clear images of excellent fixability were produced both at the beginning and after the duration test. Result of fixation test was grade-5.

EXAMPLES 26–33

Repeating the procedure of Example 24 except that the materials as shown in the following table were used, there was prepared one-component developer containing magnetic powders, which was subjected to the test.

The outer shell components were used in the form of 500 parts of xylene solution. There was obtained sharp, clear and durable fixed images.

| Example No. | Core Material | Outer shell layer | Fixability | Duration test | Triboelectric charge at the beginning (μc/g) | Triboelectric charge after duration test (μc/g) |
|---|---|---|---|---|---|---|
| 26 | The same as Example 24 | Cyclized rubber (iodine value, 65; average molecular weight, 10,000; 1 tradename, "Alpex CK-514", supplied by Hoechst) 25 parts Styrene-butadiene copolymer (85/15 wt. %, #544, supplied by Denki Kagaku) 25 parts | Grade-4 ∣ Grade-5 | Over 10,000 sheets | −12.4 | −11.3 |
| 27 | The same as Example 24 | Styrene-butadiene Copolymer of Example 26 30 parts Cyclized rubber (tradename, "Thermolite N", supplied by Seiko Kagaku) 70 parts | Grade-4 ∣ Grade-5 | Over 10,000 sheets | −11.2 | −10.2 |
| 28 | Polyethylene oxide (average molecular weight, 1500; acid value, 24; specific gravity, 0.99; melt index, 200) | Styrene-butadiene copolymer of Example 26 50 parts Cyclized rubber (tradename, "Thermolite P", supplied by Seiko Kagaku) 50 parts | Grade-4 ∣ Grade-5 | Over 10,000 sheets | −10.3 | −8.5 |
| 29 | Polyethylene oxide (average molecular weight, 1500; acid value, 24; specific gravity, 0.99; melt index, 200) | Styrene-butadiene copolymer of Example 26 20 parts Cyclized rubber (tradename, "Thermolite S", supplied by Seiko Kagaku) 80 parts | Grade-4 ∣ Grade-5 | Over 10,000 sheets | −10.2 | −7.5 |

-continued

| Example No. | Core Material | Outer shell layer | Fixability | Duration test | Triboelectric charge at the beginning (μc/g) | Triboelectric charge after duration test (μc/g) |
|---|---|---|---|---|---|---|
| 30 | Polyethylene tetrafluoride powder (tradename, "Luvlon L-5", supplied by Daikin Kogyo) | Cyclized rubber of Example 24 80 parts Styrene-maleic anhydride-n-butyl methacrylate terpolymer (tradename, "Stylite X-4", supplied by Daido Kogyo) 20 parts | Grade-4 \| Grade-5 | Over 10,000 sheets | −14.2 | −11.5 |
| 31 | Polyethylene tetrafluoride powder (tradename, "Luvlon L-5", supplied by Daikin Kogyo) | Cyclized rubber of Example 24 75 parts Polyester resin (tradename, "Atlac 382A", supplied by Kao Atlas) 25 parts | Grade-4 \| Grade-5 | Over 10,000 sheets | −15.3 | −10.2 |
| 32 | Ethylene-acryl copolymer tradename, "Pararoid B-72", supplied by Sanyo Boeki) | Cyclized rubber of Example 24 90 parts The terpolymer of Example 30 10 parts | Grade-3 \| Grade-4 | Over 10,000 sheets | −14.2 | −13.8 |
| 33 | Ethylene-acryl copolymer (tradename, "Pararoid B-72", supplied by Sanyo Boeki) | Cyclized rubber of Example 24 60 parts Cellulose acetate phthalate (supplied by Wako Junyaku) 40 parts | Grade-3 \| Grade-4 | Over 10,000 sheets | −15.0 | −12.5 |

What we claim is:

1. A pressure fixable capsule toner which comprises a core material containing a pressure fixable component and an outer shell layer of 0.1–8 microns containing at least 40% by weight of a cyclized rubber having a molecular weight from 5,000–20,000.

2. A pressure fixable capsule toner according to claim 1 in which the pressure fixable component is polyolefine.

3. A pressure fixable capsule toner according to claim 1, in which the pressure fixable component is polyethylene oxide.

4. A pressure fixable capsule toner according to claim 1 in which magnetic powders are contained.

5. A pressure fixable capsule toner according to claim 1 in which a coloring agent is contained.

6. A pressure fixable capsule toner according to claim 1 in which a charge controlling agent is contained.

7. A pressure fixable capsule toner according to claim 1 in which a lubricant is contained.

8. A pressure fixable capsule toner according to claim 1 in which an insulating resin layer overlies the outer shell layer containing a cyclized rubber.

9. A pressure fixable capsule toner according to claim 1 in which the iodine value of the cyclized rubber is 40–200.

10. A pressure fixable capsule toner which comprises a core material containing polyolefine and magnetic powders and an outer shell layer of 0.1–8 μm in thickness covering the core material and containing a cyclized rubber.

11. A pressure fixable capsule toner which comprises a core material containing polyolefine and magnetic powders, an outer shell layer covering the core material and containing a cyclized rubber, and an insulating resin layer overlying the outer shell layer.

12. A pressure fixable capsule toner which comprises a core material containing polyolefine and magnetic powders, and an outer shell layer covering the core material and containing a cyclized rubber and a styrene-butadiene copolymer.

* * * * *